US006746165B2

(12) United States Patent
de Laforcade

(10) Patent No.: US 6,746,165 B2
(45) Date of Patent: Jun. 8, 2004

(54) DEVICE FOR APPLYING A HAIR PRODUCT TO SECTIONS OF HAIR AND METHOD OF HAIR TREATMENT

(75) Inventor: Vincent de Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 10/165,276

(22) Filed: Jun. 10, 2002

(65) Prior Publication Data

US 2003/0007825 A1 Jan. 9, 2003

(30) Foreign Application Priority Data

Jun. 8, 2001 (FR) ..... 01 07552

(51) Int. Cl.[7] ..... A46B 11/00; B43M 11/06; B05C 21/00; B43K 8/12

(52) U.S. Cl. ..... 401/10; 401/9; 401/196; 401/183; 401/207; 15/244.1; 132/221; 132/270

(58) Field of Search ..... 401/10, 9, 11, 401/203, 196; 132/212, 270, 202, 207, 208; 15/244.1, 244.4

(56) References Cited

U.S. PATENT DOCUMENTS

| | | | | |
|---|---|---|---|---|
| 1,978,716 A | | 10/1934 | Morehouse | |
| 3,030,968 A | | 4/1962 | Oberstar et al. | |
| 3,056,998 A | | 10/1962 | Ebner | |
| 3,109,192 A | | 11/1963 | Levenson | |
| 3,262,459 A | * | 7/1966 | Sheehan | 132/212 |
| 3,468,318 A | | 9/1969 | Cook et al. | |
| 3,805,810 A | | 4/1974 | Savala | |
| 4,144,897 A | | 3/1979 | Mosz | |
| 4,385,638 A | | 5/1983 | Hasegawa | |
| 4,517,702 A | | 5/1985 | Jackson | |
| 4,727,893 A | | 3/1988 | Goncalves | |
| 4,830,030 A | | 5/1989 | Busch et al. | |
| 4,942,893 A | | 7/1990 | Trottier | |
| 5,016,401 A | * | 5/1991 | Mangus | 451/59 |
| 5,022,493 A | | 6/1991 | Buckelew | |
| 5,351,356 A | * | 10/1994 | Townsend, Jr. | 15/114 |
| 5,676,480 A | | 10/1997 | Tosto | |
| 5,820,285 A | * | 10/1998 | Ikeda et al. | 401/199 |
| 6,062,231 A | | 5/2000 | De Laforcade | |
| 6,626,599 B2 | | 9/2003 | De Laforcade | |

FOREIGN PATENT DOCUMENTS

| | | |
|---|---|---|
| CH | 287 396 | 4/1953 |
| DE | 662 702 | 6/1938 |
| DE | 31 18 196 | 12/1982 |
| FR | 1 529 483 | 6/1968 |
| FR | 2 589 337 | 5/1987 |
| FR | 2 764 488 | 12/1998 |

OTHER PUBLICATIONS

Co–pending application No. 09/733,052; Title: Device for Applying a Product to a Section of Hair Inventor(s): Vincent De Laforcade U.S. Filing Date: Dec. 11, 2000.
English language abstract of DE 31 18 196, Dec. 16, 1982.
Translation of Swiss Patent Application No. 287 396, published on Apr. 1, 1953.

* cited by examiner

*Primary Examiner*—David Walczak
(74) *Attorney, Agent, or Firm*—Finnegan Henderson Farabow Garrett & Dunner, L.L.P.

(57) ABSTRACT

An applicator device for applying product to at least one section of hair includes an elastically deformable component, a reservoir for the product, and a slot at least partially defined by the elastically deformable component. The slot is bounded by edges and is configured to receive a section of hair between the edges. The slot comprises a first slot portion lying in a first plane and at least one second slot portion lying in a second plane different from the first plane.

82 Claims, 8 Drawing Sheets

DEVICE FOR APPLYING A HAIR PRODUCT TO SECTIONS OF HAIR AND METHOD OF HAIR TREATMENT

The present invention relates to a device for applying a product, for example a liquid-to-viscous product, to a section of hair, and to a method of hair treatment using this device. The invention may be suitable for applying a hair dyeing product section-by-section. The device of the invention may be used for any other hair treatment, such as hair perming, or any other treatments. The invention may be used to apply a relatively liquid product, for example, under substantially clean conditions. Alternatively, the product to be applied may be in the form of a cream, a gel, or a liquid of relatively high viscosity, for example.

In at least some common hair dyeing procedures, a hair dye product may be transferred from a bowl in which the dye is contained. Such dyes may be intended either for overall use, often referred to as "whole head" use, where the hair may be completely impregnated with product so as to modify the color of substantially all of the hair, or for partial use, often referred to as use "in sections", where only certain parts of the hair may be treated with product so as to obtain, once the treatment has been completed, a substantially non-homogeneous color effect, which may emphasize hair sections with lighter or darker shades of color than the natural or overall shade of the hair. Alternatively (or in addition), the use of the product "in sections" may emphasize movement of the hair sections.

FR-A-2,589,337 describes a device for applying a hair dye, wherein the device includes a reservoir for the product to be applied and an application head fitted to the reservoir. The application head has an orifice for supplying the product, as well as a two-tined fork at its free end that the user can guide from one end of a section of hair to the other, when the section is placed between the two tines of the fork, for the purpose of applying the product to the section. A space separating the two tines extends to a base portion of the tines where the space opens into an open cavity in which the product accumulates. The supply orifice provides flow of product to the cavity. This cavity is bounded on its open face by a moveable flap capable of exposing the cavity for the purpose of cleaning the application head easily.

Another type of device for applying a hair product is described in FR-A-2,764,488. That device includes means for isolating a given section of hair and application means capable of being loaded with hair product. The hair product is applied to the isolated section by bringing the section into application contact with the application means at a given point on the section and by moving the application means relative to the section from the point towards a free end of the section. Retention means are provided for keeping the section in application contact with the application means throughout the movement.

Other types of devices for applying a hair product may be in the form of a comb having interior supply channels communicating with a product reservoir. These supply channels open out to the tips of the comb's tines or to the spaces separating the tines.

At least some conventional devices generally suffer from the same drawbacks due to their open structure. Because of this structure, the product retained on the applicator means may have a tendency to run, especially when the product is relatively liquid. Furthermore, because the hair to be treated does not form a planar surface, the user often needs to change the orientation of the application device depending on the area to be treated. Such an operation also increases the risk of the product running in undesirable areas. In addition, certain applicators of this kind have the drawback of a relatively short autonomy.

Another type of applicator is described in U.S. Pat. No. 4,942,893. With this type of applicator, a part of the hair to be dyed is introduced into a sealed capsule containing the dyeing product. The section or sections are held in the capsule throughout the time needed for the dyeing product to act. This type of applicator is well suited for applying products requiring a certain leave-in time but it is not at all suitable for the aforementioned dyeing in sections.

The present invention relates to applying a hair product in sections, wherein one or more drawbacks associated with conventional devices may optionally be obviated.

One aspect of the invention may be to provide a device allowing a hair product to be applied in a clean and non-sullying manner, for example, regardless of the viscosity of the product to be applied. Such a device may have a relatively desirable manufacturing cost.

In another aspect, the invention may provide a hair product application device which is simple to use and which allows the product to be applied over substantially an entire length of the section, from the root to the free end, or along any other length sufficient to obtain the desired dyeing. The application device may be suitable for use at home, either by the consumer himself or by a third person not having any specific experience in hair dyeing.

Further aspects of the invention will appear in more detail in the description that follows. In addition, the following description includes a discussion of a few possible embodiments of the invention. It should be understood that the aspects and embodiments described herein are merely exemplary and that the invention could be practiced without having all of the features of these aspects and embodiments.

In one aspect, there is a device for applying a hair product, for example a dyeing product, to sections of hair. The device may comprise a component made of at least one elastically deformable material and at least partly defining a reservoir of the product. The component also may at least partly define a slot that communicates with the product reservoir and opens toward the outside of the device. The slot may be bounded by at least two edges that, at rest, are substantially contiguous over at least one portion of the slot so as to create a seal. A section of hair may be able to pass through the slot so as to allow the section to be coated by the product in response to a relative movement between the device and the section in a direction longitudinal to the section. The slot may include a first portion formed in a first plane and at least one second portion formed in a second plane different from the first plane.

It should be understood that the seal created by the edges bounding the slot relates to a seal or quasi-seal relative to a given composition. For example, such a seal may at least substantially prevent flow of hair product from the slot when the device slot is in a closed position. The conditions for obtaining such a seal (for example, the density of the elastic material, the relative bearing of the edges defining the slot) may vary according to the viscosity of the product. Likewise, such a seal may correspond to a seal under normal conditions of use, for example with regard to the lifetime of the device.

One embodiment of the device may be configured to allow the support to be brought into contact with the product, continuously, over all or part of its length, and without appreciable flow of product out of the reservoir. To use the device, a user may take hold of a precise section, which may be as thin as possible, and position it in the slot.

The movement may be simple and precise and may make it possible for the desired dyeing of hair in sections to be carried out rapidly over all or part of its length. During application, the seal may be provided regardless of the position of the application device. Any accidental outflow of product may be considerably reduced when the elasticity of the elastically deformable component that defines the slot is chosen appropriately. In addition, the risk of the product coming into contact with the user's hands may be markedly reduced, as compared to at least some conventional techniques.

In some embodiments, while allowing relative movement of the component defining the slot along the section, the component may prevent substantially any movement that would lead to interrupting its contact with all or part of the section during the treatment. The section may thus be kept in the slot. With such a configuration, the section may be "pinched" between two parts of the device, without being gripped too tightly, so as to allow the device to be slid along the section from one of its ends to the other. Thus, throughout the movement of the device a portion of the hair section may be impregnated with product.

Because the slot may have portions formed in different planes, some embodiments of the component that at least partly delimits the slot may be in the form of a compact block and/or have regions of weakening formed by the various slot portions. These regions of weakening may allow the resistance of the component to be weakened as the section of hair passes through it, allowing the component to undergo slight deformation caused by the section of hair during the relative movement between the section and the slot. Thus, the section may not be excessively tight in the slot so that the rubbing by the component on the section is limited. In this way, the product may be wiped sufficiently during passage of the section in the slot, but this, however, may not be too great, so as to leave enough product on the section in order to obtain the desired dyeing.

In one aspect, the elastically deformable component may be designed so that the section, when passing through the slot, also passes through the product reservoir.

According to one aspect, one of the edges defining the slot may be formed from a portion of an enclosure that is made of a material impermeable to the product and inside which the component made of elastically deformable material may be placed. The enclosure may also have an opening lying at least opposite one portion of the slot. The opening in the enclosure may also be bounded by edges having a profile able to favor the insertion of the section into the device.

According to another aspect, at least two edges of the slot may be formed by the component and may be made of elastically deformable material. In this case, a first edge of the slot may be formed by a part of the component that may be made of a first elastically deformable material. A second edge of the slot may be formed by a second part of the component and may comprise a second elastically deformable material. In some embodiments, the reservoir may be sealed with respect to the outside even with sections of large volume, and without any substantial risk of the product flowing out of the reservoir to the outside, regardless of the position of the application device. For example, two parts of the component may be mounted so as to exert a suitable compressive force between the first and second edges. Thus, the slot may be made substantially contiguously. In addition, a relatively wide section may be held between the application means.

In an embodiment where elastic compressive force is exerted between the edges of the slot, a wiping of the section may occur during the treatment. For example, with such an arrangement excess product deposited on the section in the reservoir may be retained before the section leaves the slot while leaving a sufficient amount of product in order to obtain the desired dyeing. Thus, contact between an untreated part of hair and a section already impregnated with product may not cause undesirable dyeing of the untreated part.

In some embodiments, the wiping may not be too great, so as to leave enough product on the section in order to assist in obtaining the desired dyeing. The slot may have various configurations that make it possible to limit the wiping of the section during the treatment.

In another embodiment, at least one second portion of the slot may have an end located in the first plane in which the first portion lies. In one embodiment, the presence of such a portion in the component made of an elastically deformable material may allow the resistance of the component to be weakened during passage of the section.

According to another aspect, the slot may comprise a plurality of second portions, and each of the second portions may have a first end located in the first plane, in other words intersecting. The second portions may also be mutually parallel.

The slot may comprise at least one second portion placed on one side of the first plane, and may comprise at least one second portion placed on the other side of the first plane. The second portion(s) located on one side of the first plane may be aligned (and/or offset) with the second portion(s) located on the other side of the first plane.

The first plane may be perpendicular to the second plane.

In some embodiments, the section may be held in the first slot portion, being "pinched" between the two edges that define this portion. The second slot portions may allow the elastically deformable component to be divided into small portions capable of deforming, for example by becoming curved, on passage of the section. The second slot portions may lie in a plane substantially parallel to the axis of relative movement of the section in the first slot portion, so as assist in the deformation of the elastically deformable component caused by the section.

According to other aspects, the profile of the slot may be in the form of at least one of a sawtooth, a crenellation, and a wave, for example. Thus, the section may be kept in the slot, being "pinched" between the two edges which define the slot and which have a profile that may not lie in the same plane across an entire length of the slot. Here again, the elastically deformable component may be, on its surface defining the slot, divided into several small portions capable of deforming upon passage of the section.

In one aspect, the elastically deformable material(s) may be chosen from the group of elastomers chosen from ethylene-propylene copolymers; polyether-block-amides; polyvinyls; ethylene-propylene-diene terpolymers (EPDM); styrene-butadiene-styrene block copolymers (SBS); styrene-ethylene butylene-styrene/styrene-isoprene-styrene block copolymers (SEBS-SIS); thermoplastic polyurethanes; blends of polypropylene with one of the following elastomers: styrene-ethylene butylene-styrene/styrene-isoprene-styrene block copolymers (SEBS-SIS); ethylene-propylene-diene terpolymers (EPDM); and styrene-butylene-styrene block copolymers (SBS).

In one aspect, the slot may extend over an opening angle of from 20° to 320°, for example a range from 120° to 200°. The slot may be produced in the elastically deformable component, partially, for example, by mechanical cutting (using a knife) or thermal cutting (using a laser) among other methods. The slot may be produced over a depth of approximately 1 mm to approximately 20 mm, for example a depth of approximately 3 mm to approximately 8 mm.

According to another aspect, the two edges of the slot may open onto the outside of the component made of elastically deformable material by being flared one with respect to the other. Thus, the insertion of the section into the slot may be facilitated.

According to one aspect, the product reservoir may be bounded, at least partly, by a hollowed-out portion of the component made of elastically deformable material. Thus, the component made of elastically deformable material may form, for example, a cylinder whose center is hollowed out so as to form the product reservoir.

According to another aspect, the product reservoir may be formed inside the actual structure of the material forming the elastically deformable component, such as by open or semi-open cells which intercommunicate multidirectionally. In this case, it may be possible to produce the component made of elastically deformable material in the form of a solid cylinder.

The elastically deformable component may comprise a sponge or a foam, for example, the size of the open or semi-open cells of which may be between approximately 0.1 mm and approximately 2.5 mm.

The foam or the sponge may be hydrophilic, such as polyurethane, viscose or polyester sponges or foams, for example. Such materials may permit the section of hair to be slipped gently between the edges of the slot. In certain cases, depending on the nature of the product to be applied and of the support, it may be desired to use a hydrophobic foam or sponge, such as polyethylene, polypropylene or polyether sponges, among others.

In one aspect, the application device may include a hole that may be closed off, for example reversibly, so as to allow the reservoir to be filled with the product. This hole may be made in the enclosure.

The enclosure may be made by moulding, or otherwise forming, a relatively rigid thermoplastic chosen from polyethylenes, polypropylenes, polystyrenes, polyvinyl chlorides, polyethylene terephthalates, etc. Other materials may also be used. Such an enclosure may be moulded in two or three pieces, without a reverse taper. The enclosure may be made of a transparent or translucent material or any other material suitable for making it possible to check the filling level of the reservoir with product.

In another aspect, the application device of the invention may furthermore include gripping means, such as an elongate handle, for example.

Means may be provided for immobilizing the component made of elastically deformable material inside the enclosure. The component made of elastically deformable material may be immobilized inside the enclosure by pinching, for example by means of one (or two) fitted lid(s) closing off the enclosure. Such pinching may be achieved, for example, by one or more notches or sharp edges placed on the lid(s) or a portion of the enclosure, in contact with the lid(s). The lid(s) may be fixedly or removably mounted.

The application device of the invention may furthermore include means for allowing the device to be mounted on a container. This container may be able to form an auxiliary reservoir containing a relatively large amount of product. In this case, the container may be brought, permanently or selectively, into communication with the product reservoir. The container may have deformable walls, making it possible, by compressing it, to transfer a dose of product into the product reservoir. The auxiliary container, when fastened to the enclosure, may also serve as a gripping means for the device.

According to one aspect, the device may have a cross section whose width decreases towards one end. The end with the narrowest cross section may allow easy access to the roots of the hair to be treated. For example, a device of approximately triangular cross section may be used.

Another aspect relates to a method for applying a hair product, for example a dyeing product, to sections of hair. The method includes isolating a hair section to be coated with the product, and passing the section through a slot at least partly bounded by a component made of at least one elastically deformable material and at least partly defining a reservoir for the product with which the slot is in communication. The slot opens toward the outside of the device and is bounded by at least two edges which, at rest, are substantially contiguous over at least one portion of the slot so as to create a seal. The slot comprises a first portion formed in a first plane and at least one second portion formed in a second plane different from the first plane. The method further includes moving the elastically deformable component with respect to the hair section in a direction longitudinal to the section.

According to another aspect, an applicator device for applying a product to at least one section of hair includes a component formed of at least one elastically deformable material, a reservoir for a product, and a slot in communication with the reservoir. The slot may be at least partially defined by said component and may be accessible from an outside of the device, said slot being bounded by edges configured to be placed in a substantially contiguous position along at least one portion of the slot so as to create a seal. The slot may be configured to permit at least one section of hair to pass through the slot and become coated with product in response to movement of the device in a longitudinal direction with respect to the section of hair. The slot may comprise a first slot portion formed in a first plane and at least one second slot portion formed in a second plane different from the first plane.

In one aspect, the applicator device may comprises a base portion and a leading edge, wherein a width of the slot at the base portion is greater than a width of the slot at the leading edge.

In another aspect, the applicator device may comprise a slot that is at its widest at the base portion and gradually narrows to its narrowest width at the leading edge.

In yet another aspect, the applicator device may comprise a slot that narrows to a point at the leading edge.

According to another aspect, a method of applying a product to at least one section of hair includes providing an applicator device as disclosed herein, passing a section of hair through the slot, and moving the device longitudinally with respect to the section of hair to transfer product from the device to the section of hair.

The term "providing" is used broadly, and refers to, but is not limited to, making available for use, giving, supplying, obtaining, getting a hold of, acquiring, purchasing, selling, distributing, possessing, making ready for use, and/or placing in a position ready for use.

According to yet another aspect, there is a product application system comprising an auxiliary reservoir and an applicator device as described herein, the applicator device being configured to provide flow communication between the reservoir of the applicator device and the auxiliary reservoir.

In another aspect, a method of applying a hair product to at least one section of hair comprises selecting a section of hair to be coated with the product and passing the selected section of hair through a slot defined at least partially by substantially contiguous edge portions. The slot may be at least partly bounded by a component formed of at least one elastically deformable material, and the component may at least partly define a reservoir containing a product. The slot may be in communication with the reservoir, and the slot may have a first slot portion lying in a first plane and at least one second slot portion lying in a second plane different from the first plane. The method may further include moving the component in a longitudinal direction with respect to the section of hair to transfer the product to the section of hair.

In another aspect, an applicator device for applying a product to at least one section of hair includes an elastically deformable component, a reservoir for the product, wherein the reservoir being positioned in the elastically deformable component, and a slot at least partially defined by the elastically deformable component. The slot may be bounded by edges and configured to receive a section of hair between the edges, wherein the slot comprises a first slot portion lying in a first plane and at least one second slot portion lying in a second plane different from the first plane.

The accompanying drawings are included to provide a further understanding of the invention and are incorporated in and constitute a part of this specification. The drawings illustrate exemplary embodiments of the invention and, together with the description, serve to explain certain principles. In the drawings, FIG. 1 is a perspective view of an exemplary embodiment of the application device;

Figure 1:
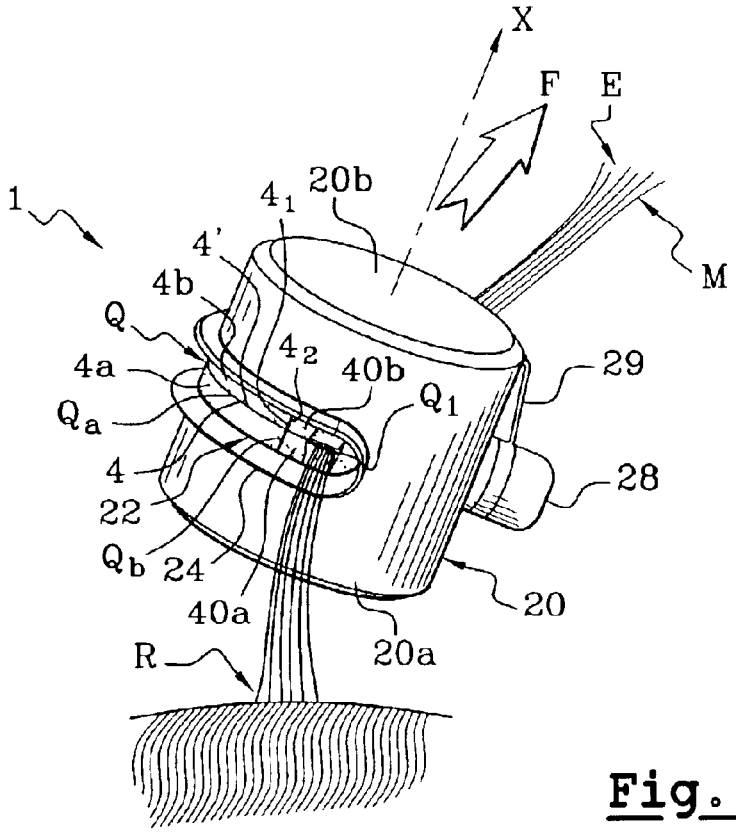

Reference will now be made in detail to exemplary embodiments of the invention, examples of which are illustrated in the accompanying drawings. Wherever possible, the same reference numbers are used in the drawings and the description to refer to the same or like parts, and the same reference numbers with alphabetical suffixes or numerical prefixes are used to refer to similar parts.

FIGS. 1 to 5, to which reference is now made, illustrate various views of a first embodiment of the application device 1 according to the invention.

Figure 2:
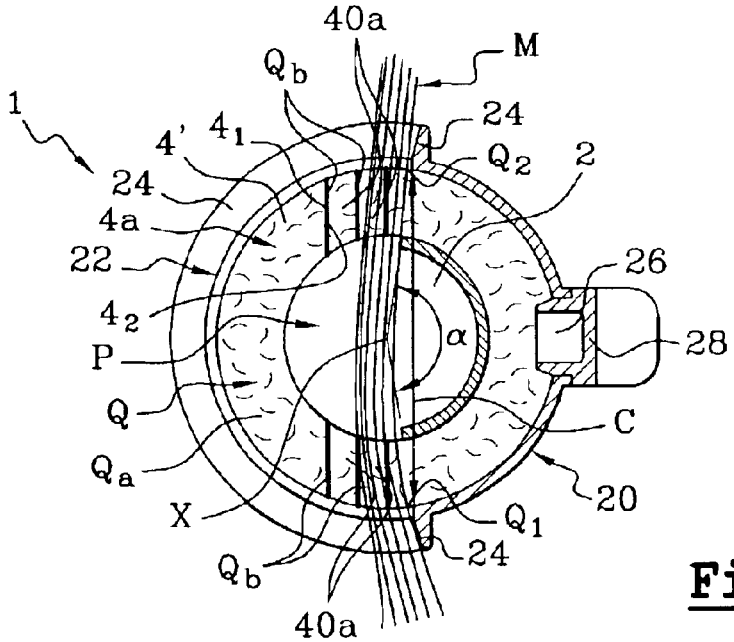
FIG. 2 is a schematic cross sectional view of the device depicted in FIG. 1.

FIGS. 1 and 2 show an isolated section M of hair, passing between two edges 4, 4' of a slot Q of the application device 1. The two edges 4, 4' are each formed from a transverse portion of a cylinder made of a cellular foam having open or semi-open cells. The cylinder is axisymmetric about an axis X. The cylinder is hollowed out at its center and includes a stack of two foam blocks 4*a*, 4*b*, stacked along the axis X. In this embodiment, each of the two foam blocks 4*a*, 4*b* is made of elastically deformable foam of the same type.

It may be seen that the two blocks 4*a*, 4*b* forming the foam cylinder are separated at their interface by a slot portion $Q_a$ perpendicular to the axis X and having an opening angle $\alpha$ slightly greater than 180°. The slot $Q_a$ is substantially contiguous and is bounded by two ends $Q_1$ and $Q_2$ so that the chord C joining the ends of the slot passes approximately through the center of the reservoir 2. The foam cylinder 4*a*, 4*b* may be formed, for example, of hydrophilic foam such as polyurethane foam having cells with a mean size of approximately 1.5 mm. The hollowed-out central part of the cylinder forms a reservoir 2 for a product P of liquid consistency, such as a hair dye composition.

Slots $Q_b$ perpendicular to the main slot $Q_a$ are formed on either side of the main slot $Q_a$, in each foam block 4*a* and 4*b*. Each of the slots $Q_b$ is bounded by two edges $\mathbf{4}_1$ and $\mathbf{4}_2$ of the same foam block. One end of each slot $Q_b$ lies in the plane defined by the main slot $Q_a$. Three slots may be provided in each block and at each end $Q_a$ and $Q_2$ of the main slot $Q_a$, namely in the region through which the section passes. The three slots $Q_b$ of one of the foam blocks are aligned with the three slots of the other foam block. Each slot $Q_b$ is formed over the entire transverse width of each block, and at least over part of the axial height of the block. Small foam block portions 40*a* and 40*b* are thus bounded by the slots $Q_b$. Each slot $Q_b$ may be approximately parallel to the chord C connecting the two ends $Q_1$ and $Q_2$ of the main slot $Q_a$. Thus, the slots $Q_b$ are approximately parallel to the axis of movement of the section.

The foam cylinder 4*a*, 4*b* may be placed in a rigid enclosure such as a capsule 20, of cylindrical overall shape, for example, composed of a part 20*a* forming a receptacle with a closed bottom and of a lid 20*b*. The lid is fixed, for example, by snap-fastening, to the open end of the receptacle 20*a*.

The capsule 20 has an opening 22 of elongate shape, so as to expose the slot Q and define the end $Q_1$ as far as the end $Q_2$. Thus, the opening 22 is oriented in a plane perpendicular to the axis X. The opening 22 is bordered by a slightly flared guiding lip 24 which may assist in the introduction of the section M into the slot Q and may prevent the hair from being damaged when moving the application device.

The capsule 20 is provided with a filling hole 26 which may be closed off by means of a removable plug 28. The plug 28 is joined to the body of the capsule 20 by means of a flexible strip 29, which may avoid losing the plug.

The filling hole 26 is used for fitting into the capsule 20 the dispensing nozzle of an external auxiliary reservoir which may have a large volume of product and allows a suitable dose of the product to be introduced into the reservoir 2. The external reservoir may be fitted into the hole 26 permanently or temporarily.

The capsule 20 and the lid 20*b* may be made by moulding, for example by moulding a relatively rigid thermoplastic, such as polyethylene or polypropylene, among others. This material may be transparent or translucent, which may make it possible to check the level of product filling in the reservoir 2.

Figure 3:
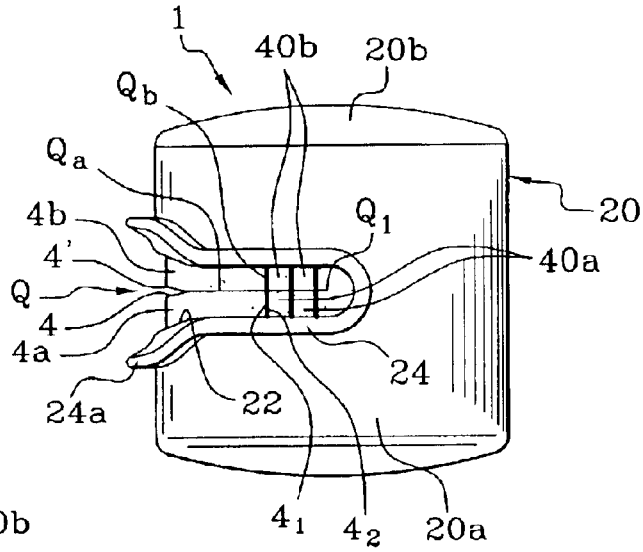
FIGS. 3 to 5 are various views of an applicator device according to the embodiment of FIGS. 1 and 2.
Figure 4:
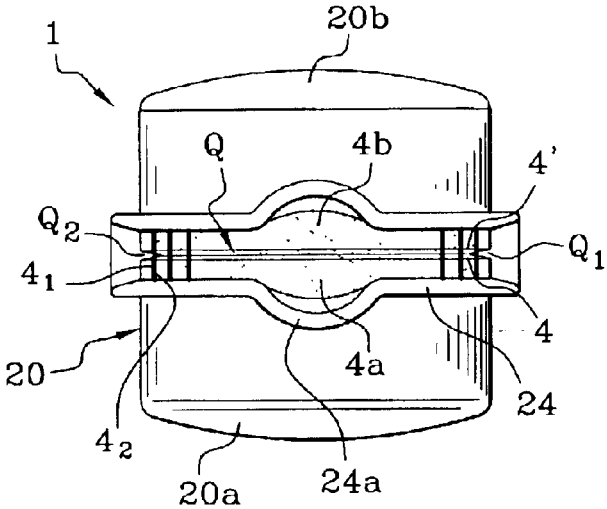

In FIGS. 3 and 4, for the sake of simplification, the filling hole of the device 1 has not been illustrated. These figures show, in greater detail, various aspects of the embodiment described above.

FIGS. 3 and 4 show side and front views, respectively, of the device of FIG. 1. These figures show that the slot $Q_a$ is slightly flared around its periphery, which may assist in the introduction of the section portion to be treated into the reservoir 2. In that part of the slot surrounding the reservoir 2, the slot $Q_a$ is substantially contiguous. The opening 22 made in the capsule 20 is bordered by a projecting guiding lip 24. The profile of this lip 24 converges on the slot $Q_a$. The lip 24 has a central portion 24*a* which defines a preferred introduction region of greater width.

Figure 5:
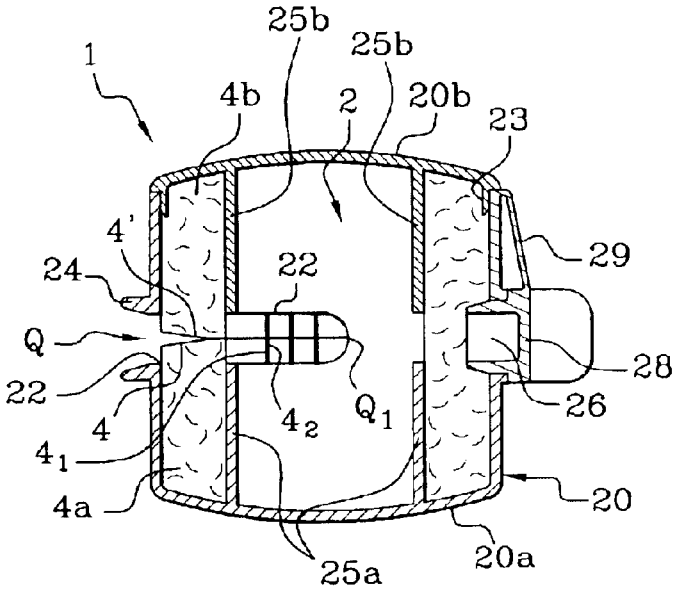

FIG. 5 shows that the foam cylinder 4*a*, 4*b* is held in the capsule 20 by skirts 25*a* and 25*b* concentric with the outer cylindrical wall of the capsule 20. These skirts 25*a* and 25*b* are carried by the receptacle 20*a* and the lid 20*b*, respectively. The skirts have a height such that an annular space is formed, allowing the product contained in the reservoir to come into contact with the foam.

The foam cylinder may be elastically compressed axially. The degree of compression may be chosen so that the slot may be sealed just enough to prevent the product from flowing out of the reservoir. At the same time, a portion of the section, on which it is desired to apply the product, may be able to be introduced more easily. After treatment, the section portion may leave the slot correctly wiped, leaving the necessary amount of product for dyeing the sections of hair.

To use the device that has just been described, a section M to be treated may be separated from the rest of the hair. The user may then take hold of the device 1, which may be prefilled with product P, in one hand.

Next, by passing through the opening 22 in the capsule, a portion of the section M may be introduced into the slot $Q_a$, where it may be sandwiched by the foam edges 4, 4' defining the slot. Thus, the section portion may lie in a region extending substantially between the two ends $Q_1$ and $Q_2$ of the slot, near the chord C. In this way, the portion of the section M, elastically trapped between the edges 4, 4' may pass through the reservoir 2 so as to be in contact with the product P. The user, by moving the application device 1 from the root R of the section as far as its free end E, along the direction of the arrow F, may impregnate all or part of the section with the product P, and may do so depthwise. The foam blocks 40*a* and 40*b* bounded by the slots $Q_b$ may tend to bend slightly as the section passes through so that rubbing of the foam against the section may be limited. Thus, enough product may remain on the section to obtain the desired dyeing. This operation may also be carried out in the opposite direction. This process may be repeated, section by section, as many times as desired. This entire operation may be performed under clean conditions.

The treated section (M) may be completely controlled and held throughout its treatment. At the end of the movement, that is to say when the applicator arrives at the free end of the section, the latter may be carefully rested against the rest of the hair. In the case of a dyeing product, its viscosity may be such that the product cannot migrate significantly towards the other parts of the hair which are not treated, so as not to spoil the aesthetic appearance of the application thus carried out.

In the embodiment shown in FIGS. 1–5, the product may have a low viscosity without any risk of leakage out of the reservoir, regardless of the position in which the device is held by the user during the treatment. This may be because the pressure between the edges 4, 4' may be chosen so that the section can emerge from the slot correctly wiped while leaving enough product on the section to obtain the desired dyeing.

Figure 6:
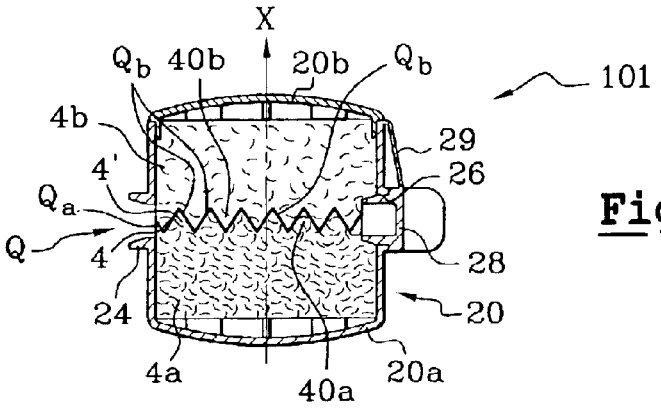
FIG. 6 is an axial sectional view of another exemplary embodiment of an applicator device.

FIG. 6 shows an embodiment 101 similar to the embodiment in FIGS. 1 to 5. The capsule 20 in FIG. 6 is identical to that in FIGS. 1 to 5. The embodiment in FIG. 6 may be distinguished from that in FIGS. 1 to 5 by the fact that the foam blocks 4*a* and 4*b* are of different type. Thus, the portion 4*a* is formed from foam in which the size of the cells and/or the compressibility and/or the constituent material may be different from the foam forming the portion 4*b*.

This embodiment may also be distinguished from that in FIGS. 1 to 5 by the fact that the foam blocks 4*a*, 4*b* form a solid cylinder. Furthermore, the slot Q bounded by two edges 4 and 4 ' has a profile in the form of a sawtooth. The slot Q is thus formed from a first portion $Q_a$ and from a plurality of second portions $Q_b$ placed in relation to one another so as to form sawteeth. The end of each tooth may be located opposite the opening 22 of the capsule so as to make it easier for the section to be introduced into the slot. Each tooth 40*a* and 40*b* of each block 4*a* and 4*b* may have a tendency to become slightly curved on passage of the section so that the rubbing of the foam on the section may be limited. In this example, the blocks 4*a* and 4*b* may each be formed from foam of different type. The reservoir containing the product to be applied may be formed in this case by the open cells of the blocks 4*a* and 4*b*.

Figure 7:
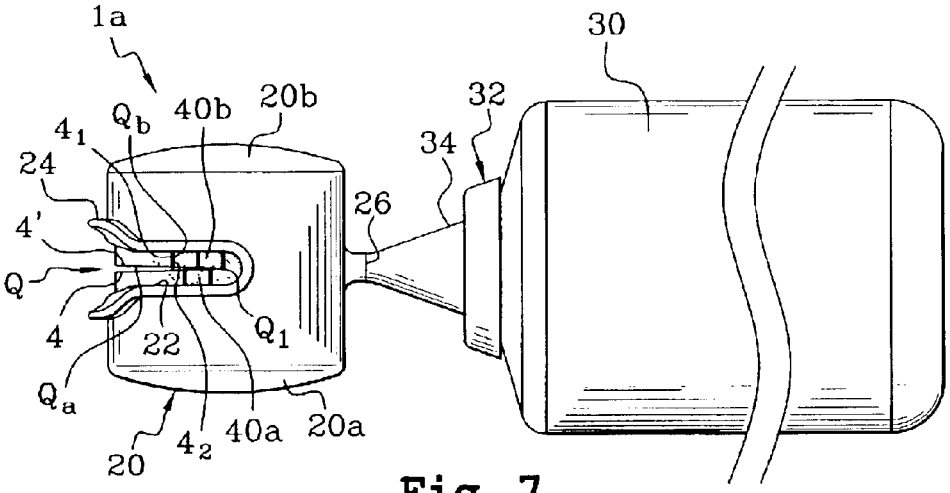
FIGS. 7 and 8 are perspective views of other exemplary embodiments of applicator devices.

FIG. 7 shows an application device 1*a* comprising a capsule 20 similar to that illustrated in FIGS. 1 to 5. According to the embodiment shown, an external auxiliary product reservoir 30 is fitted into the filling hole 26 of the capsule 20. This external reservoir 30 may be formed from a compressible bottle, made of a suitable thermoplastic, for example polyethylene, and containing a relatively large amount of product. The reservoir 30 is associated with a dispensing nozzle 32 provided with an adapter 34 capable of communicating with the filling hole 26. In the configuration illustrated, the external reservoir 30 and the capsule 20 (which is provided with the foam block 4*a*, 4*b*) form a fixed application assembly, which can be supplied with product by the user at any time. Thus, by compressing the external reservoir 30, the user can inject a dose of product into the capsule 20, for the purpose of replenishing the impregnation of the edges 4, 4' of the slot. In this case, the external reservoir 30 may also serve as a gripping component during application of the product. Moreover, the slot Q of this embodiment is formed by a main slot $Q_a$ and, on the other hand, by several slots $Q_b$ lying in a plane substantially perpendicular to the plane in which the main slot $Q_a$ is formed. Each of the slots $Q_b$ is bounded by two edges $\mathbf{4}_1$ and $\mathbf{4}_2$ of the same foam block. One end of each slot $Q_b$ lies in the plane defined by the main slot $Q_a$. For example, three slots $Q_b$ are provided on each side of the slot $Q_a$, namely in each of the blocks 4*a* and 4*b* and at each end $Q_1$ and $Q_2$. In this embodiment, the slots $Q_b$ of the foam block 4*a* do not lie opposite the slots $Q_b$ of the foam block 4*b*, but are offset with respect to one another.

Figure 8:
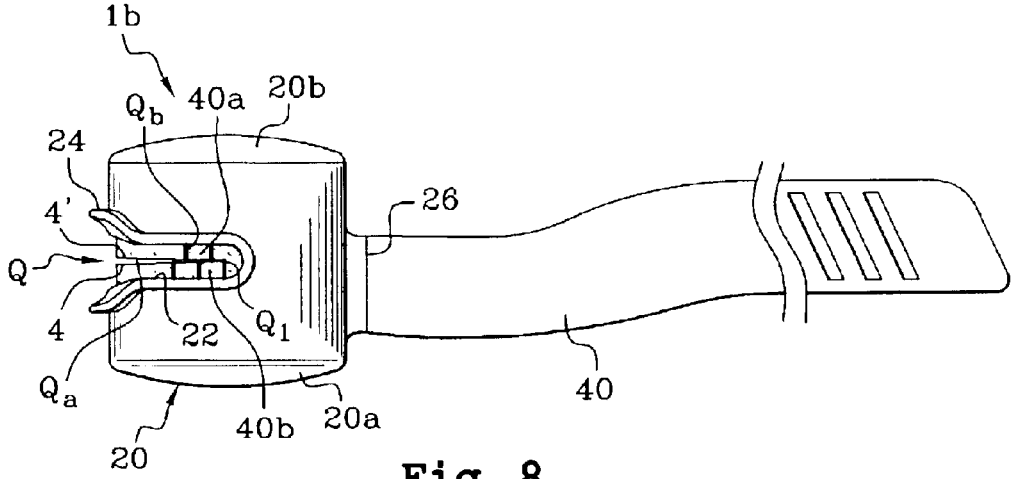

FIG. 8 illustrates an application device 1*b*, which includes a capsule 20 similar to that illustrated in FIGS. 1 to 5. In the embodiment shown, a gripping handle 40 is fitted into the filling hole 26 of the capsule 20. The handle 40 may be removable, in order to make it possible to introduce, through the filling hole, a dose of product into the capsule 20. After filling, the handle 40 is attached to the capsule so as to close off the filling hole 26. The slot Q is similar to that described in conjunction with FIG. 10.

Figure 9:
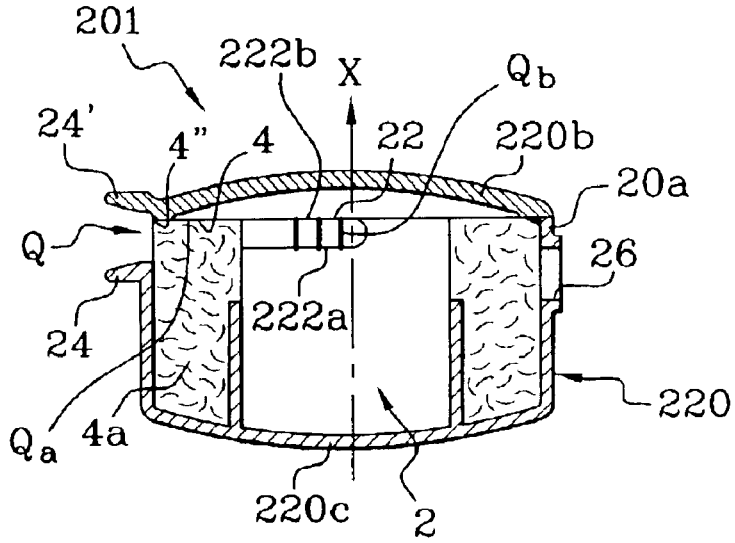
FIGS. 9 and 10 are axial sectional views of yet other exemplary embodiments of applicator devices.

FIG. 9 illustrates an embodiment of an application device 201. According to this embodiment, a capsule 220 is formed from a bowl-shaped lower receptacle 220*c* and a lid 220*b*. The receptacle 220*c* has substantially the same structure as the lower half of the capsule 20 in FIGS. 1 to 5. A single hollow foam cylinder 4*a* is placed inside the capsule 220. The foam cylinder 4*a* forms an application surface 4 in elastic and sealed contact with a rigid portion 4" of the lid. Thus, a contiguous slot Q is formed between the foam surface 4 and the portion 4" of the edge of the lid 220*b*. The foam cylinder 4*a* has slots $Q_b$, for example three in number, one end of which lies in the plane defined by the slot $Q_a$. The slots $Q_b$ are, for example, substantially perpendicular to the slot $Q_a$. The lid may have an outwardly convex internal profile.

A portion 222*a* of the receptacle 220*c* of the capsule may be hollowed out so as to form, with a corresponding region 222*b* of the lid 220*b*, an elongate opening 22 oriented at right angles to the axis X. The opening 22 is bordered around its entire periphery by a two-part guiding lip, a first part 24 of which is integral with the receptacle 220*c* and a second part 24' of which is integral with the lid 220*b*.

Thus, when a section portion is introduced into the slot $Q_a$, so as to pass through the reservoir 2, the product contained in the reservoir may uniformly impregnate the section portion.

Figure 10:
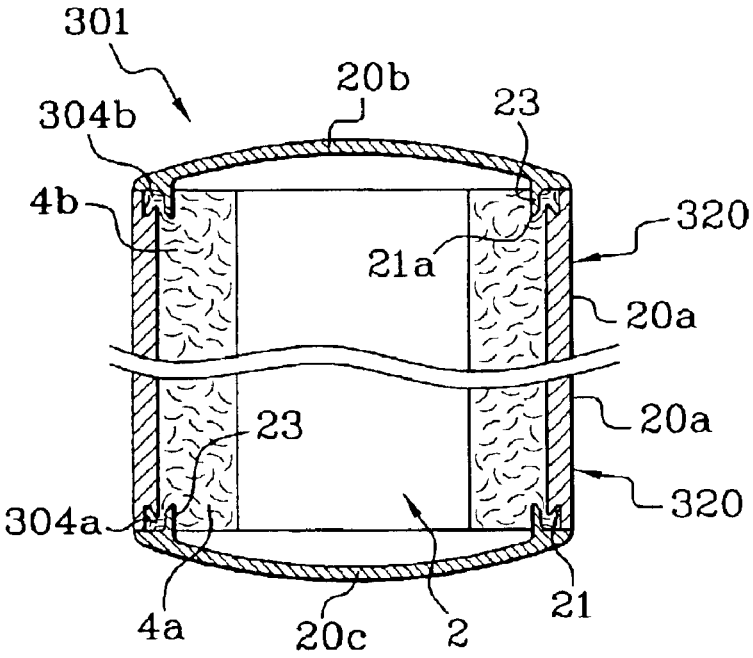

FIG. 10 shows a partial view of device 301, illustrating the fitting of a foam cylinder made in two parts 4*a*, 4*b* inside one particular capsule 320. The capsule 320 has a cylindrical body 20*a*, open at each end, each end being closed by a corresponding lid 20*b*, 20*c* of identical shape. The lid 20*b* (20*c*) has an annular sealing skirt 23, the outside diameter of which is slightly less than the inside diameter of the body 20*a*. Each free end of the body 20*a* has an annular portion of smaller thickness, so as to define an internal projection 21. The internal projection 21 has a sharp annular edge 21*a* oriented in the direction of the corresponding lid. Each sharp annular edge 21*a* may be continuous or discontinuous.

When fitting the capsule 320, the foam cylinder 4*a*, 4*b* may be placed inside the body 20*a*. Next, by attaching each of the lids 20*b* and 20*c* to the corresponding end of the body 20*a*, for example by snap-fastening, adhesive bonding, or force-fitting, an annular foam portion 304*a*, 304*b* may be pinched between the sharp edge 21*a* and the annular skirt 23.

Of course, when the foam cylinder 4*a*, 4*b* is made as a single piece, it may be sufficient to attach it by only one of its ends. In this case, the second lid, opposite that used for attaching the foam, may be removed. Thus, the second lid may serve as a plug, which may be removed in order to introduce the product into the reservoir 2, and which may be replaced after filling.

Such a capsule can be used with foam blocks defining a slot Q, such as those that have just been described in conjunction with FIGS. 1 to 8.

According to one embodiment of the invention, illustrated in FIGS. 11 to 17, the application device 1, instead of being cylindrical, is of elongate shape. It has a cross section, the width of which decreases towards an end E, for example a cross section of substantially triangular shape. This embodiment may make it possible to reach the roots more easily, because of the relatively narrow end of the device. Apart from this particular shape, the device shown in FIGS. 11 to 17 is substantially similar to that described in conjunction with FIG. 1. According to this embodiment, the slot $Q_a$ is defined by two independent foam blocks, which are each held in the capsule 20.

Figure 11:
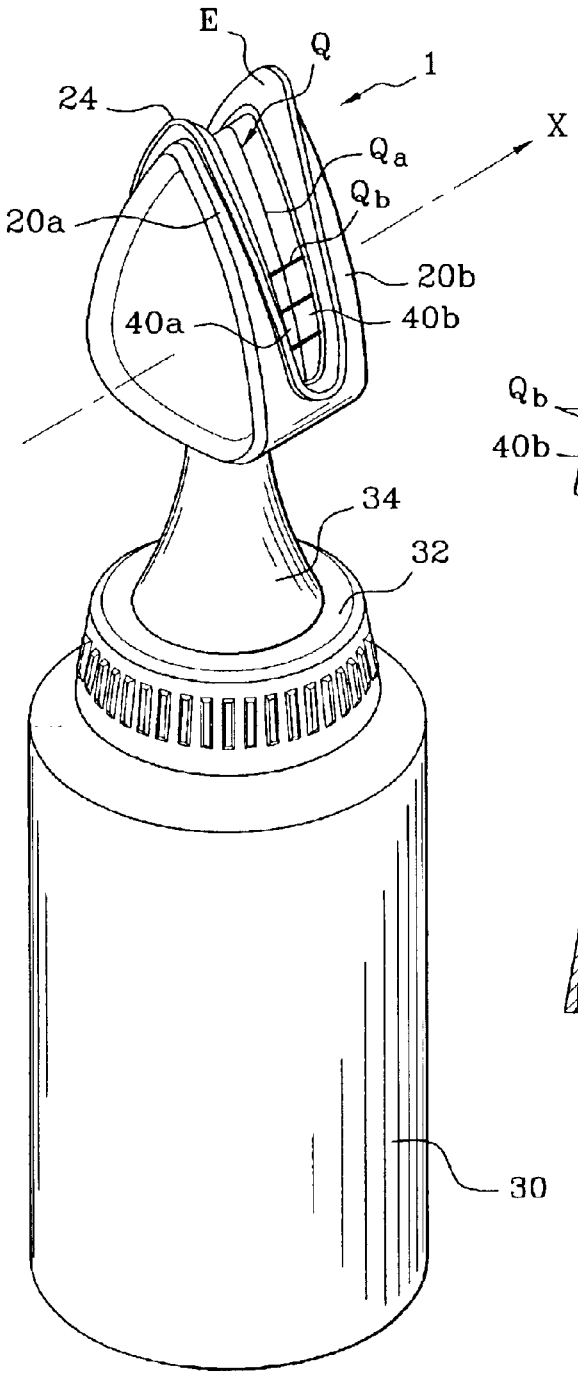
FIG. 11 is a perspective view of another exemplary embodiment of an applicator device.
Figure 12:
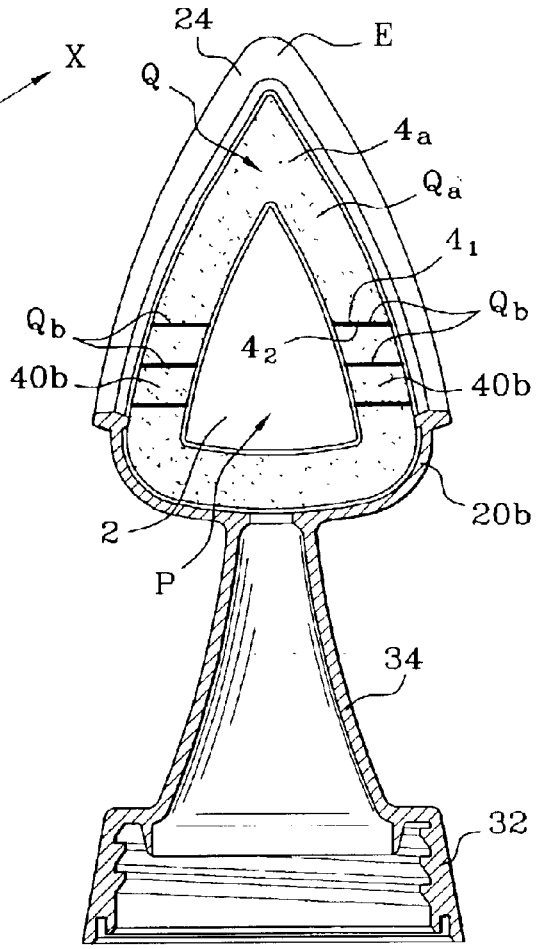
FIG. 12 is a cross sectional view of the device illustrated in FIG. 11.
Figure 13:
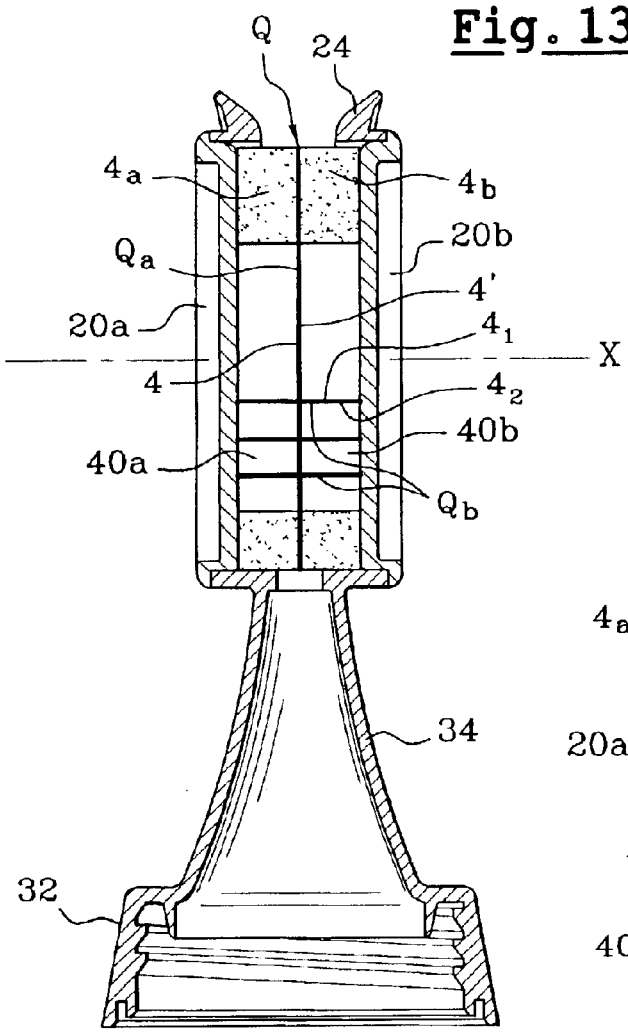
FIG. 13 is an axial sectional view of the device illustrated in FIG. 11.

In the configuration illustrated in FIGS. 11 to 13, three slot portions $Q_b$, bounded by edges 41 and 42, emerge in the main slot $Q_a$, on each side of the main slot $Q_a$. The slot portions $Q_b$ of one of the blocks face those of the other block and are preferably located towards the base of the triangle, namely in the region where the section passes through the device. They are formed so as to define, in each block, two smaller foam block portions 40*a* and 40*b* which become curved on passage of the section.

Figure 14:
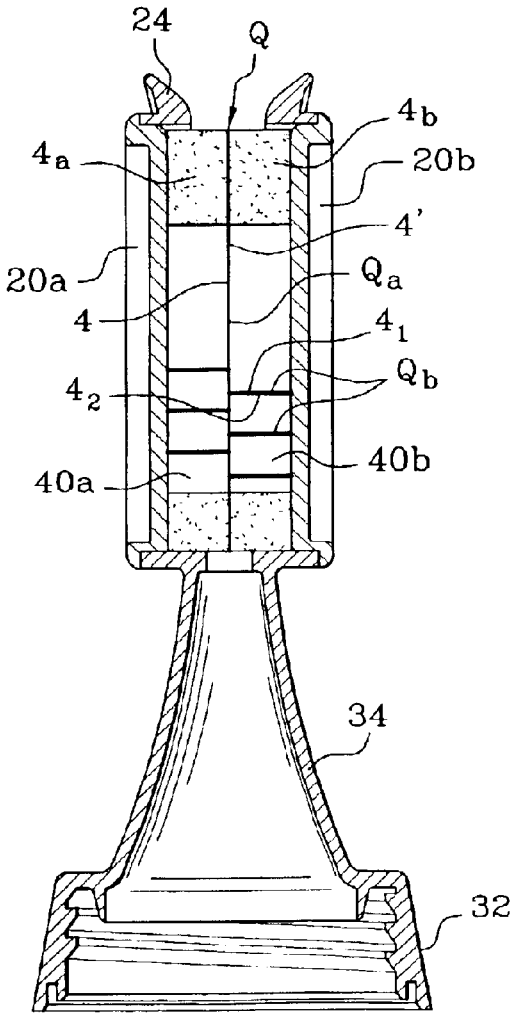
FIGS. 14 to 17 are axial sectional views of various alternative configurations of the exemplary embodiment illustrated in FIG. 11.

In the configuration illustrated in FIG. 14, three slots $Q_b$ are formed in each block 4*a* and 4*b*, but this time they are offset with respect to one another.

Figure 15:
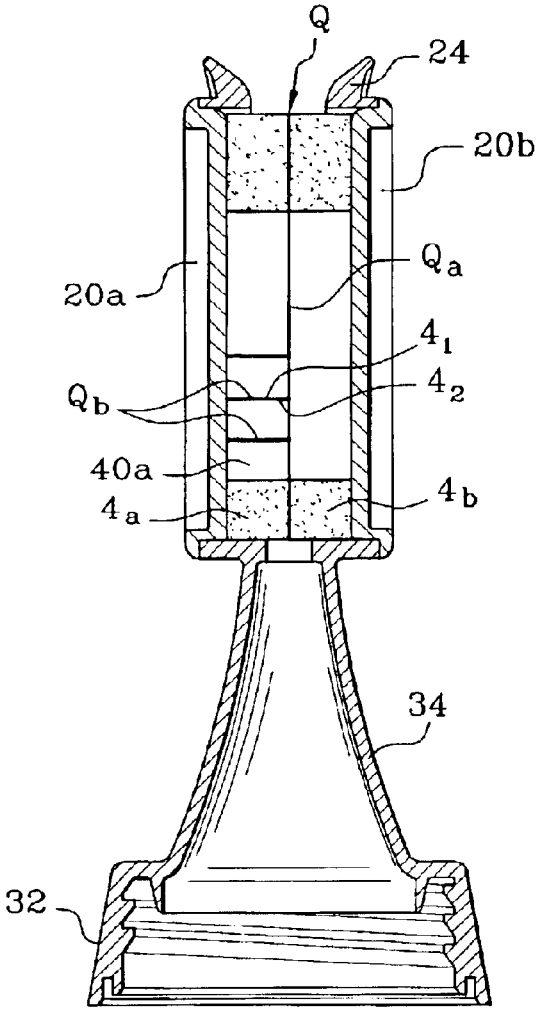

FIG. 15 illustrates another configuration of the embodiment in FIG. 11, in which slots $Q_b$ are formed only on one side of the main slot $Q_a$.in a single block 4*a*.

Figure 16:
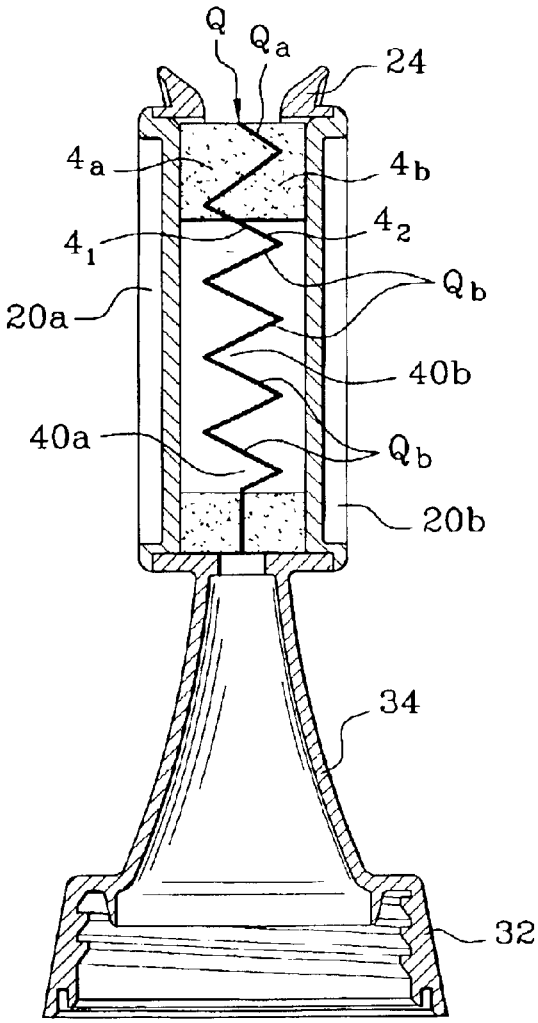

The slot shown in FIG. 16 has a cross section with a sawtooth profile. Here again, the teeth 40*a* and 40*b* defined between each slot portion $Q_a$ and $Q_b$ may become curved on passage of the section through the device.

Figure 17:
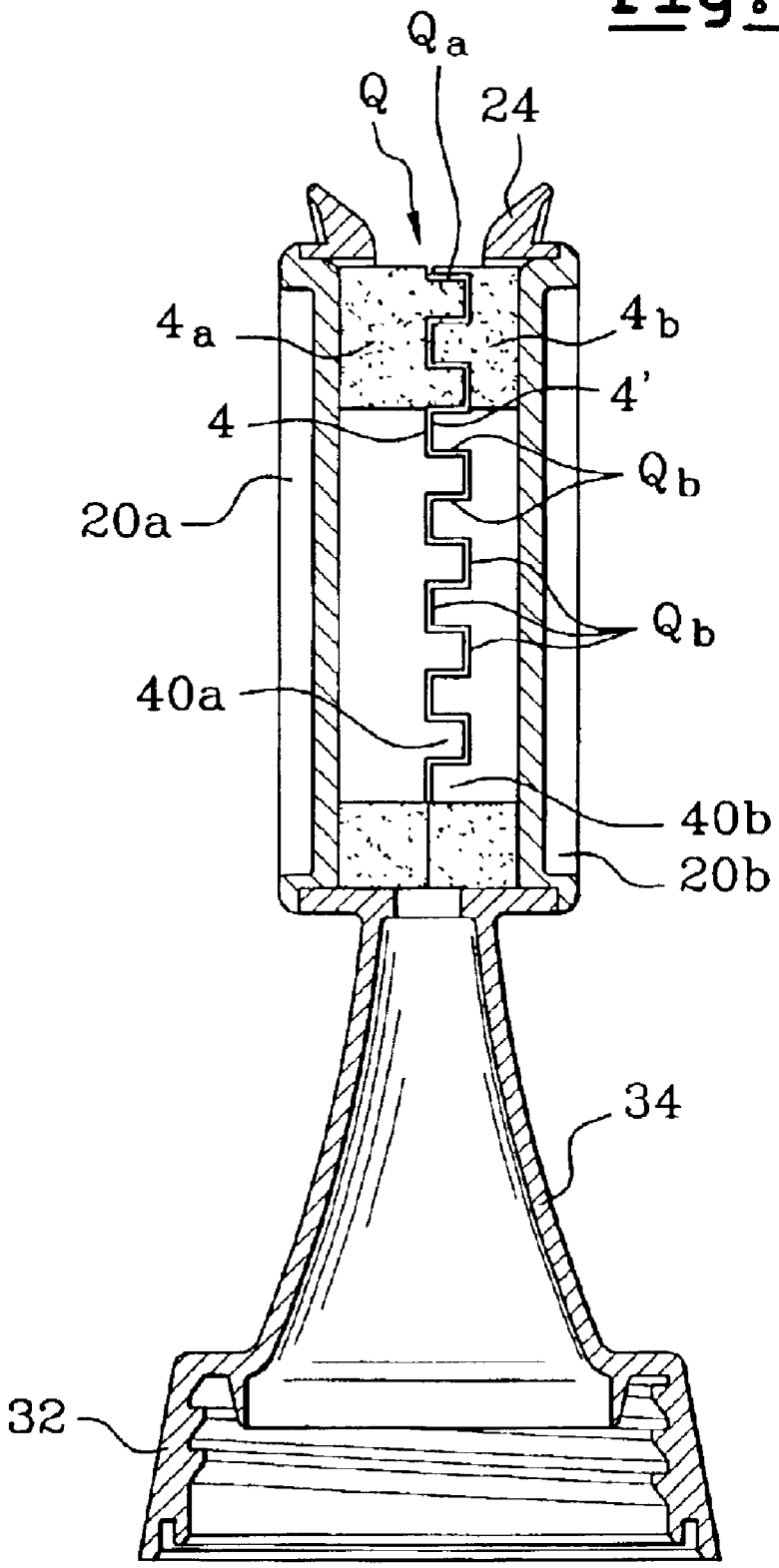

Finally, FIG. 17 illustrates another configuration of the embodiment in FIG. 11, in which the slot Q has a cross section with a crenellated profile.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. An applicator device for applying a product to at least one section of hair, said device comprising:

a component formed of at least one elastically deformable material;

a reservoir for a product; and a slot in communication with the reservoir, the slot being at least partially defined by said component and being accessible from an outside of the device, said slot being bounded by edges configured to be placed in a substantially contiguous position along at least one portion of the slot so as to create a seal, wherein the slot is configured to permit at least one section of hair to pass through the slot and become coated with product in response to movement of the device in a longitudinal direction with respect to the section of hair, said slot comprising a first slot portion formed in a first plane and at least one second slot portion formed in a second plane different from the first plane.

2. The applicator device of claim 1, wherein the device is configured such that the section of hair passing through the slot also passes through the product reservoir.

3. The applicator device of claim 1, further comprising an enclosure formed of a material impermeable to the product, at least a portion of the component being disposed in the enclosure.

4. The applicator device of claim 3, wherein a portion of the enclosure defines one of the edges of the slot.

5. The applicator device of claim 3, wherein the enclosure comprises an opening configured to permit access to the slot from the outside of the device.

6. The applicator device of claim 5, further comprising guiding members in the vicinity of the opening, the guiding members being configured to guide insertion of the section of hair into the device.

7. The applicator device of claim 3, further comprising an element configured to immobilize the component in the enclosure.

8. The applicator device of claim 7, wherein the component is immobilized in the enclosure by a fitted lid configured to pinch the component and close off the enclosure.

9. The applicator device of claim 3, wherein the enclosure is comprised of a material that is at least one of transparent and translucent.

10. The applicator device of claim 1, wherein at least two of the edges of the slot are formed by the component.

11. The applicator device of claim 10, wherein one edge of the slot is formed by a first part of the component and the other edge of the slot is formed by a second part of the component, the first part comprising an elastically deformable material, and the second part comprising a second elastically deformable material.

12. The applicator device of claim 1, wherein said at least one second slot portion intersects with the first slot portion.

13. The applicator device of claim 12, wherein the slot comprises a plurality of second slot portions.

14. The applicator device of claim 13, wherein each of the plurality of second slot portions intersects with the first slot portion.

15. The applicator device of claim 14, wherein each of the plurality of second slot portions is substantially mutually parallel to each other.

16. The applicator device of claim 10, wherein at least one of the plurality of second slot portions lies substantially on one side of the first plane and at least one other of the plurality of second slot portions lies substantially on the other side of the first plane.

17. The applicator device of claim 16, wherein the at least one of the plurality of second slot portions lying on one side of the first plane is substantially aligned with the at least one other of the plurality of second slot portions lying on the other side of the first plane.

18. The applicator device of claim 16, wherein the at least one of the plurality of second slot portions lying on one side of the first plane is offset with respect to the at least one other of the plurality of second slot portions lying on the other side of the first plane.

19. The applicator device of claim 13, wherein the slot extends over an opening angle of from 120° to 200°.

20. The applicator device of claim 1, wherein the first plane is substantially perpendicular to the second plane.

21. The applicator device of claim 1, wherein the profile of the slot comprises at least one of a sawtooth, a crenellation, and a wave.

22. The applicator device of claim 1, wherein the at least one elastically deformable material is chosen from ethylene-propylene copolymers; polyether-block-amides; polyvinyls; ethylene-propylene-diene terpolymers (EPDM); styrene-butadiene-styrene block copolymers (SBS); styrene-ethylene butylene-styrene/styrene-isoprene-styrene block copolymers (SEBS-SIS); thermoplastic polyurethanes; blends of polypropylene with styrene-ethylene butylene-styrene/styrene-isoprene-styrene block copolymers (SEBS-SIS); blends of polypropylene with ethylene-propylene-diene terpolymers (EPDM); and blends of polypropylene with styrene-butadiene-styrene block copolymers (SBS).

23. The applicator device of claim 1, wherein the slot extends over an opening angle of from 20° to 320°.

24. The applicator device of claim 1, wherein the edges of the slot are flared with respect to one another to define an open portion configured to facilitate insertion of the section of hair into the slot.

25. The applicator device of claim 1, wherein the reservoir is at least partly bounded by a hollowed-out portion of the component.

26. The applicator device of claim 25, wherein the component is a hollowed-out cylinder having a center portion forming the reservoir.

27. The applicator device of claim 1, wherein the product reservoir is located inside the component.

28. The applicator device of claim 27, wherein the elastically deformable material comprises at least one of open and semi-open cells intercommunicating multidirectionally.

29. The applicator device of claim 28, wherein each of said at least one of open and semi-open cells has a maximum dimension of from 0.1 mm to 2.5 mm.

30. The applicator device of claim 27, wherein the component is in the form of a solid cylinder.

31. The applicator device of claim 1, further comprising a resealable passage configured to allow the reservoir to be filled with the product.

32. The applicator device of claim 1, further comprising a grip associated with the component.

33. The applicator device of claim 1, further comprising a mount configured to allow mounting of the applicator device on an auxiliary reservoir.

34. The applicator device of claim 1, wherein the reservoir is at least partly defined by the component.

35. The applicator device of claim 1, wherein the slot comprises a base portion and a leading edge, and wherein a width of the slot at the base portion is greater than a width of the slot at the leading edge.

36. The applicator device of claim 35, wherein the slot is widest at the base portion and gradually narrows to its narrowest width at the leading edge.

37. The applicator device of claim 35, wherein the slot narrows to a point at the leading edge.

38. The applicator device of claim 35, wherein the applicator device has a substantially triangular shape in at least one plane.

39. The applicator device of claim 1, wherein a cross section of the device has a width decreasing towards one end.

40. The applicator device of claim 1, further comprising a hair product contained in the reservoir.

41. The applicator device of claim 40, wherein the product is a hair dye.

42. The applicator device of claim 1, wherein the slot is bounded by two of the edges.

43. The applicator device of claim 42, wherein when the slot is in the substantially contiguous position, the edges are substantially contiguous over said at least one portion of the slot.

44. The applicator device of claim 1, wherein the component is configured to bias at least one of the edges toward the substantially contiguous position.

45. A product application system comprising:

an auxiliary reservoir; and the applicator device of claim 1, the applicator device being configured to provide flow communication between the reservoir of the applicator device and the auxiliary reservoir.

46. The product application system of claim 45, wherein the auxiliary reservoir is one of permanently and selectively placed into communication with the product reservoir.

47. The product application system of claim 45, wherein the auxiliary reservoir comprises at least one deformable wall.

48. The product application system of claim 45, further comprising a hair product contained in the auxiliary reservoir.

49. A method of applying a product to at least one section of hair, comprising:

providing the applicator device of claim 1, wherein the reservoir contains a product;

passing a section of hair through the slot; and moving the device longitudinally with respect to the section of hair to transfer product from the device to the section of hair.

50. The method of claim 49, wherein the product transferred to the section of hair is a hair dye.

51. The method of claim 49, further comprising passing the product from an auxiliary reservoir to the reservoir of the applicator device.

52. A method of applying a hair product to at least one section of hair, the method comprising:

selecting a section of hair to be coated with the product;

passing the selected section of hair through a slot defined at least partially by substantially contiguous edge portions, the slot being at least partly bounded by a component formed of at least one elastically deformable material, the component at least partly defining a reservoir containing a product, the slot being in communication with the reservoir, the slot having a first slot portion lying in a first plane and at least one second slot portion lying in a second plane different from the first plane; and moving the component in a longitudinal direction with respect to the section of hair to transfer the product to the section of hair.

53. The method of claim 52, wherein the product transferred to the section of hair is a hair dye.

54. The method of claim 52, further comprising passing product from an auxiliary reservoir to the reservoir.

55. An applicator device for applying a product to at least one section of hair, comprising:

an elastically deformable component;

a reservoir for the product, the reservoir being positioned in the elastically deformable component;

a hair product contained in the reservoir; and a slot at least partially defined by the elastically deformable component, the slot being bounded by edges and being configured to receive a section of hair between the edges, and wherein the slot comprises a first slot portion lying in a first plane and at least one second slot portion lying in a second plane different from the first plane.

56. The applicator device of claim 55, further comprising an enclosure, at least a portion of the elastically deformable component being disposed in the enclosure.

57. An applicator device for applying a product to at least one section of hair, comprising:

an elastically deformable component;

a reservoir for the product, the reservoir being positioned in the elastically deformable component; and a slot at least partially defined by the elastically deformable component, the slot being bounded by edges and being configured to receive a section of hair between the edges, and wherein the slot comprises a first slot portion lying in a first plane and at least one second slot portion lying in a second plane different from the first plane, wherein the elastically deformable component is formed of an elastically deformable material comprising at least one of open cells and semi-open cells.

58. The applicator device of claim 57, wherein at least some of the cells of the elastically deformable component are in fluid communication with the reservoir.

59. The applicator device of claim 58, wherein the cells of the elastically deformable component form at least part of the reservoir.

60. The applicator device of claim 55, wherein the elastically deformable component comprises a first block formed of a first elastically deformable material and a second block formed of a second elastically deformable material.

61. The applicator device of claim 60, wherein the slot is defined by the first and second blocks of material.

62. The applicator device of claim 55, wherein the elastically deformable component is in the form of a hollow cylinder.

63. The applicator device of claim 62, wherein the reservoir is in a hollow portion of the component.

64. The applicator device of claim 55, wherein the elastically deformable component is configured such that the section of hair received by the slot is placed in fluid communication with the reservoir.

65. An applicator device for applying a product to at least one section of hair, comprising:

an elastically deformable component;

a reservoir for the product, the reservoir being positioned in the elastically deformable component; and a slot at least partially defined by the elastically deformable component, the slot being bounded by edges and being configured to receive a section of hair between the edges, and wherein the slot comprises a first slot portion lying in a first plane and at least one second slot portion lying in a second plane different from the first plane, wherein the edges bounding the slot are configured to be placed in a substantially contiguous position so as to create a seal.

66. The applicator device of claim 55, wherein the at least one second slot portion intersects with the first slot portion.

67. The applicator device of claim 66, wherein the slot comprises a plurality of second slot portions.

68. The applicator device of claim 67, wherein each of the plurality of second slot portions intersects with the first slot portion.

69. The applicator device of claim 68, wherein each of the plurality of second slot portions is substantially mutually parallel to each other.

70. The applicator device of claim 67, wherein at least one of the plurality of second slot portions lies substantially on one side of the first plane and at least one other of the plurality of second slot portions lies substantially on the other side of the first plane.

71. The applicator device of claim 70, wherein the at least one of the plurality of second slot portions lying on one side of the first plane is substantially aligned with the at least one other of the plurality of second slot portions lying on the other side of the first plane.

72. The applicator device of claim 70, wherein the at least one of the plurality of second slot portions lying on one side of the first plane is offset with respect to the at least one other of the plurality of second slot portions lying on the other side of the first plane.

73. The applicator device of claim 55, wherein the first plane is substantially perpendicular to the second plane.

74. The applicator device of claim 55, wherein the profile of the slot comprises at least one of a sawtooth, a crenellation, and a wave.

75. The applicator device of claim 55, wherein the slot comprises a base portion and a leading edge, and wherein a width of the slot at the base portion is greater than a width of the slot at the leading edge.

76. The applicator device of claim 75, wherein the slot is widest at the base portion and gradually narrows to its narrowest width at the leading edge.

77. The applicator device of claim 75, wherein the slot narrows to a point at the leading edge.

78. The applicator device of claim 75, wherein the applicator device has a substantially triangular shape in at least one plane.

79. The applicator device of claim 55, wherein a cross section of the device has a width decreasing towards one end in at least one plane.

80. A method of applying a product to at least one section of hair, comprising:

providing an applicator device for applying the product to at least one section of hair, the device comprising:

an elastically deformable component;

a reservoir for the product, the reservoir being positioned in the elastically deformable component; and a slot at least partially defined by the elastically deformable component, the slot being bounded by edges and being configured to receive a section of hair between the edges, and wherein the slot comprises a first slot portion lying in a first plane and at least one second slot portion lying in a second plane different from the first plane, wherein the reservoir contains the product; passing a section of hair through the slot; and moving the device longitudinally with respect to the section of hair to transfer product from the device to the section of hair.

81. The method of claim 80, wherein the product transferred to the section of hair is a hair dye.

82. The method of claim 80, further comprising passing the product from an auxiliary reservoir to the reservoir of the applicator device.

* * * * *

UNITED STATES PATENT AND TRADEMARK OFFICE

CERTIFICATE OF CORRECTION

PATENT NO. : 6,746,165 B2
DATED : June 8, 2004
INVENTOR(S) : Vincent De Laforcase It is certified that error appears in the above-identified patent and that said Letters Patent is hereby corrected as shown below:

Column 13,
Line 11, "claim 10," should read -- claim 13, --.

Signed and Sealed this

Twenty-first Day of December, 2004

JON W. DUDAS
*Director of the United States Patent and Trademark Office*